United States Patent [19]

Baggio et al.

[11] Patent Number: 5,012,598

[45] Date of Patent: May 7, 1991

[54] FOOT SECURING DEVICE WITH AUTOMATIC RELEASE, PARTICULARLY FOR REAR-ENTRY SKI BOOTS

[75] Inventors: Giorgio Baggio, S. Martino di Lupari; Giuseppe De Bortoli, Montebelluna, both of Italy

[73] Assignee: Nordica S.r.l., Montebelluna, Italy

[21] Appl. No.: 417,100

[22] Filed: Oct. 4, 1989

[30] Foreign Application Priority Data

Oct. 11, 1988 [IT] Italy ..... 82594 A/88

[51] Int. Cl.[5] ..... A43B 5/04

[52] U.S. Cl. ..... 36/119; 36/50; 36/117

[58] Field of Search ..... 36/117-121, 36/50

[56] References Cited

U.S. PATENT DOCUMENTS 4,433,456 2/1984 Baggio ..... 36/50
4,616,524 10/1986 Bidoia ..... 36/120 X
4,622,765 11/1986 Baratto et al. ..... 36/120
4,631,839 12/1986 Bonetti et al. ..... 36/117 X
4,672,755 6/1987 Benoit et al. ..... 36/117
4,698,920 10/1987 Benoit et al. ..... 36/117 X
4,719,709 1/1988 Vaccari ..... 36/117
4,719,710 1/1988 Pozzobon ..... 36/119
4,790,081 12/1988 Benoit et al. ..... 36/117 X

FOREIGN PATENT DOCUMENTS 0248149 12/1987 European Pat. Off. ..... 36/117

*Primary Examiner*—David T. Fidei
*Assistant Examiner*—Ted Kavanaugh
*Attorney, Agent, or Firm*—Guido Modiano; Albert Josif

[57] ABSTRACT

A securing device having a winding device associated with a rear quarter of the ski boot. The winding device has a pulley for winding a cable acting on a foot. A tab has a first end fixed to the shell of the ski boot and a second end engaging a toggle for selectively locking or unlocking the pulley, depending on the rear quarter being closed or open.

7 Claims, 2 Drawing Sheets

1
2
3
4
5
6
7
8
9
10
11
12
13
14
15

FOOT SECURING DEVICE WITH AUTOMATIC RELEASE, PARTICULARLY FOR REAR-ENTRY SKI BOOTS

BACKGROUND OF THE INVENTION

The present invention relates to a foot securing device with automatic release, particularly usable in rear entry ski boots.

Various devices are currently known which allow to lock and adjust the tension of one or more traction elements arranged inside a boot in order to secure the foot therein.

For the activation of the cable, the same Applicant filed a U.S. Pat. No. 4433456 granted on Feb. 28, 1984 which describes a knob for winding the cable on a spool which remains automatically in locked position by virtue of the presence of ratchet elements which interact with a toothed surface. More specifically, the ratchet elements include a spring loaded pivoting pawl having an engagement tooth adapted for selective releasable engagement with the toothed surface, such toothed surface being defined on a flange whose rotation corresponds to a rotation of the spool. In the locked position of the pawl, the pawl engagement tooth, by means of its engagement with the toothed surface of the flange, does not allow a rotation of the flange in a releasing direction and therefore, since any rotation of the flange corresponds to a rotation of the spool, prevents a corresponding releasing rotation of the spool. For unlocking of the spool to allow an unwinding of the cable thereon, the pawl can be pivoted to an unlocked position in which the pawl engagement tooth does not interfere with the toothed surface of the flange.

In order to release and consequently unwind the cable from the spool it is necessary to rotate said knob in the opposite direction, such knob being provided with an actuation projection which, when the knob is rotated in the opposite direction, contacts a shoulder of the pawl which pivots the pawl to a disengagement position in which the pawl engagement tooth does not interfere with the toothed surface so that the flange is free to rotate in the direction corresponding to the unwinding rotation of the spool.

Though it is obviously valid in its conceptual embodiment, said device has a disadvantage for the user which is due to the need to actuate the knob both during locking and during release.

This operation can be intrinsically unpleasant considering that the actuation knob is generally mounted on the rear quarter and the skier usually grips it wearing gloves.

As a partial solution to this disadvantage, the same Applicant filed on July 23, 1985 a patent application Ser. No. 21669 A/85, which discloses a foot securing device with an automatic release assembly which comprises a pointer which interacts with locking means, engaging a spool for winding a cable, and with the quarter when it is closed, said locking means disengaging from the spool when the quarter is opened.

However, even this device has disadvantages: it is in fact possible to cause an accidental release due, for example, to a lack of pressure exerted at the pointer.

Said device furthermore does not allow the partial opening of the quarters, for example when walking, since the pointer does not exert an adequate pressure when the rear quarter is even slightly open.

In rear-entry ski boots, it is common to employ a padding which is upwardly associated at the rear quarter and downwardly overlaps a flap which protrudes from the shell and usually interacts with the foot securing cable.

Such padding renders the mentioned pointer intrinsically unusable, since the pointer is not sufficiently spaced from the flap.

SUMMARY OF THE INVENTION

The aim of the present invention is therefore to eliminate the disadvantages described above in known kinds of foot securing device by providing an invention which rapidly and easily releases the securing device upon the opening of the quarters, all this without acting directly on the cable winding knob.

Within the scope of the above described aim, another important object is to provide an invention in which the release of the foot securing device occurs by means of a single operation.

Not least object is to provide a device which associates the preceding characteristics with that of being reliable and safe in use, being free from possible accidental releases.

The above described aim and objects, as well as others which will become apparent hereinafter, are achieved by a foot securing device with automatic release, particularly for rear-entry ski boots as defined in the appended claims wind at least a cable means acting on foot securing means; said winding device having toggle means having a locking position, in which said pulley means is prevented from turning, and an unlocked position in which said pulley means is free to rotate to unwind said cable means, characterized in that it comprises a tab having a first end connected to a fixed portion of said boot and a second end engaging said toggle means of said winding device when said rear quarter is in said open position to unlock said pulley means to allow rotation thereof and unwinding of said cable means.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figures 1, 2, 3:
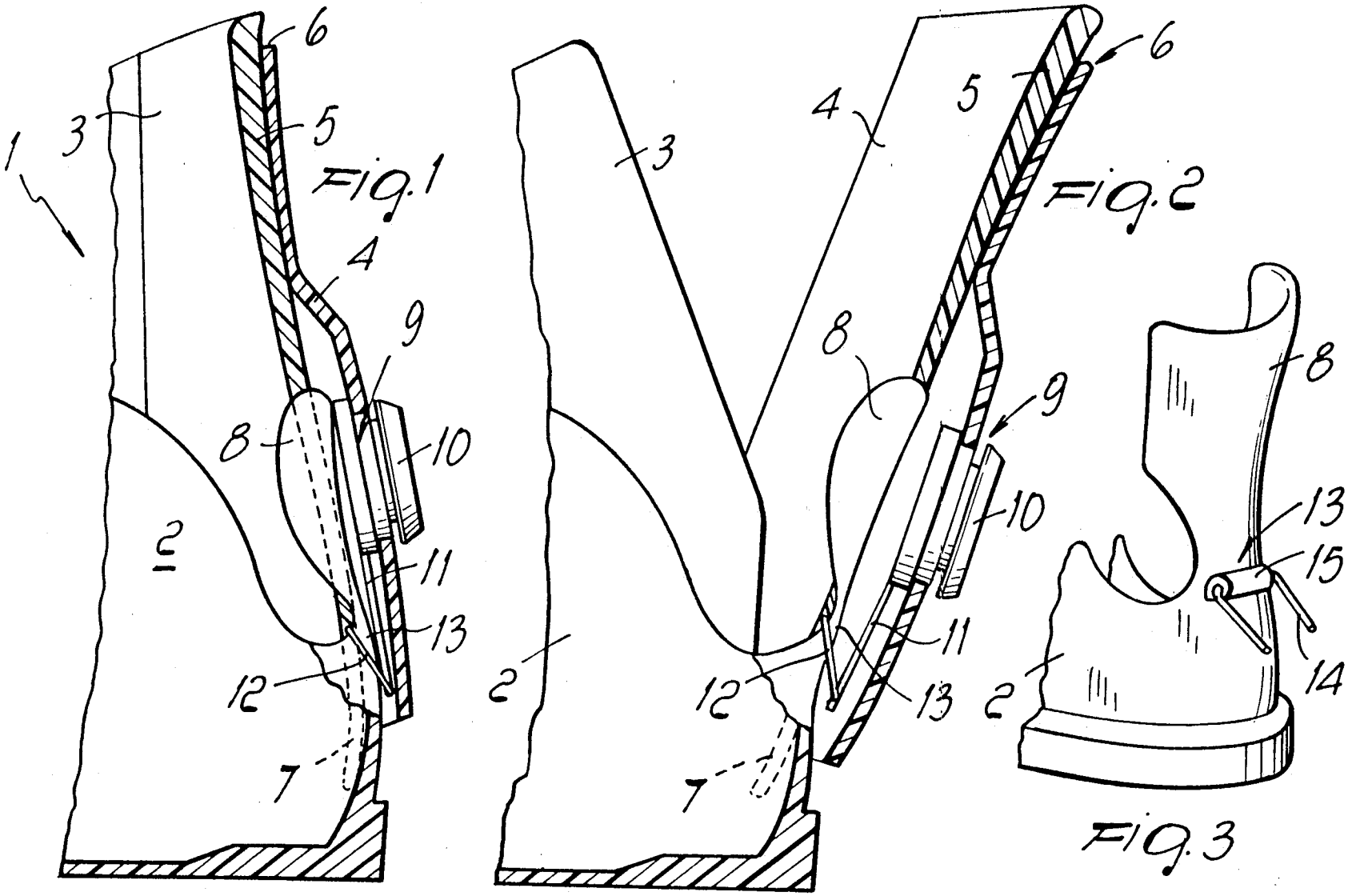
FIG. 1 is a view, taken along a middle longitudinal sectional plane with respect to the boot, of the device applied to the rear quarter with the quarters closed.
FIG. 2 is a view, similar to the preceding one, showing the rear quarter open.
FIG. 3 is a partial perspective view of the shell with a different method of applying the automatic release.

With reference to the previously described figures, the reference numeral 1 indicates a ski boot of the rear-entry type which is therefore constituted by a shell 2 with which a front quarter 3 and a rear quarter 4 are associated.

A padding 5 is arranged at said rear quarter and is coupled proximate to the upper perimetric edge 6 of said rear quarter 4.

Said padding 5 is furthermore provided with an end 7 which is accommodated inside the shell 2 and is arranged inside a flap 8 which protrudes from the shell 2 at the heel region; one or more cables interact on said flap for securing the foot inside the boot.

Said cables can be actuated by means of a winding assembly 9 which is rotatably associated with the rear quarter and has a knob 10 which is arranged outside said rear quarter and can be actuated by the skier.

The winding assembly 9 internally comprises a spool for winding said one or more cables and means for removably or releasably locking the rotation of the spool in the cable unwinding direction.

Said removable locking means are usually constituted, as has been previously described for the device shown in U.S. Pat. No. 4,433,456, by ratchet elements which interact with a preset set of teeth defined on a flange which is rigidly associated with said spool.

The winding assembly 9 is furthermore located between the inner lateral surface of the rear quarter 4 and the outer lateral surface of the facing flap 8.

At least one tab 11 protrudes from the winding assembly 9 inside the rear quarter 4 and preferably in the direction of the shell heel region, and its free end is associated with an element for coupling to a fixed component of the boot.

Said coupling element is advantageously constituted by a cable 12 which is associated with the bridge 13 connecting the flap 8 and the shell 2.

As an alternative, the coupling element may be constituted by a clip 14 associated at a transverse lug 15 which protrudes rearwardly to said bridge 13.

The other end of said coupling element, whether composed of a cable or of a clip, is then associated at a fixed point of the boot.

The other end of the tab 11 instead interacts with said means for the removable locking of the rotation in the unwinding direction of said cable which can be associated with said spool, and said interaction activates said removable locking means (so as to prevent the unwinding of the spool) with the rear quarter in closed condition (as illustrated in FIG. 1) and so as to deactivate them when the quarter is opened.

Figure 5:
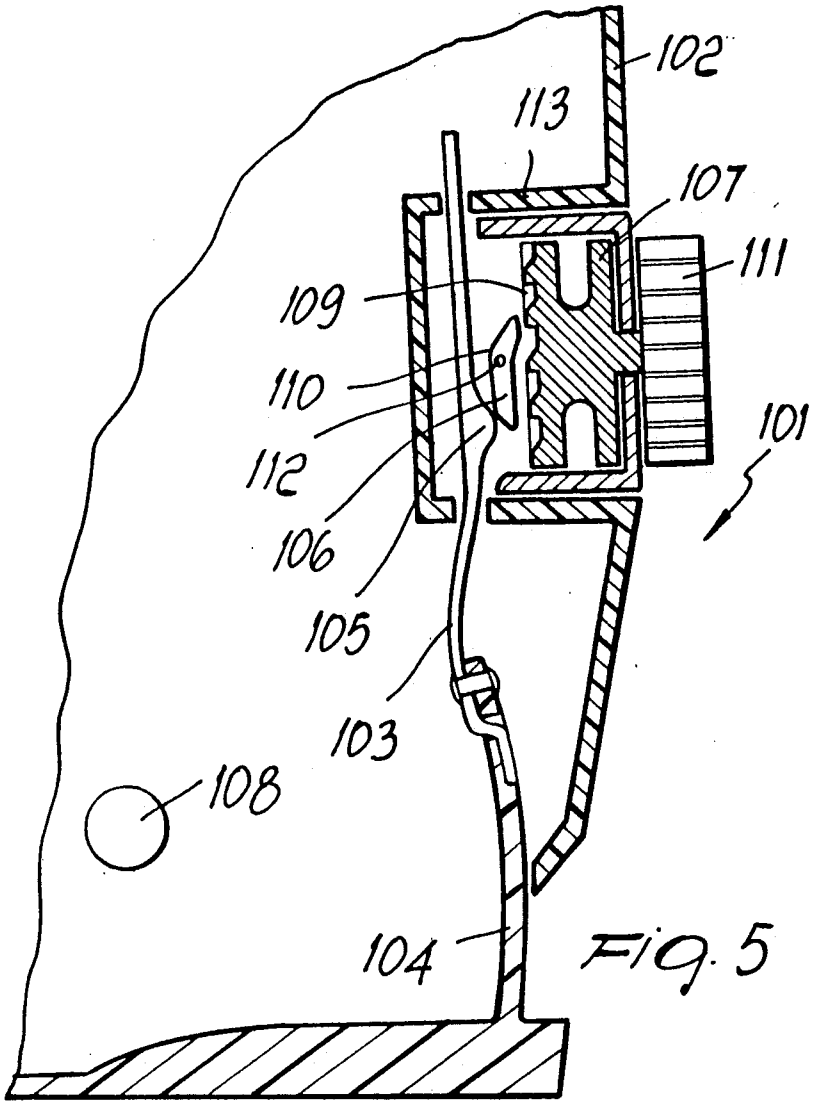
FIG. 5 is the same view of FIG. 4, showing the rear quarter open.
Figure 4:
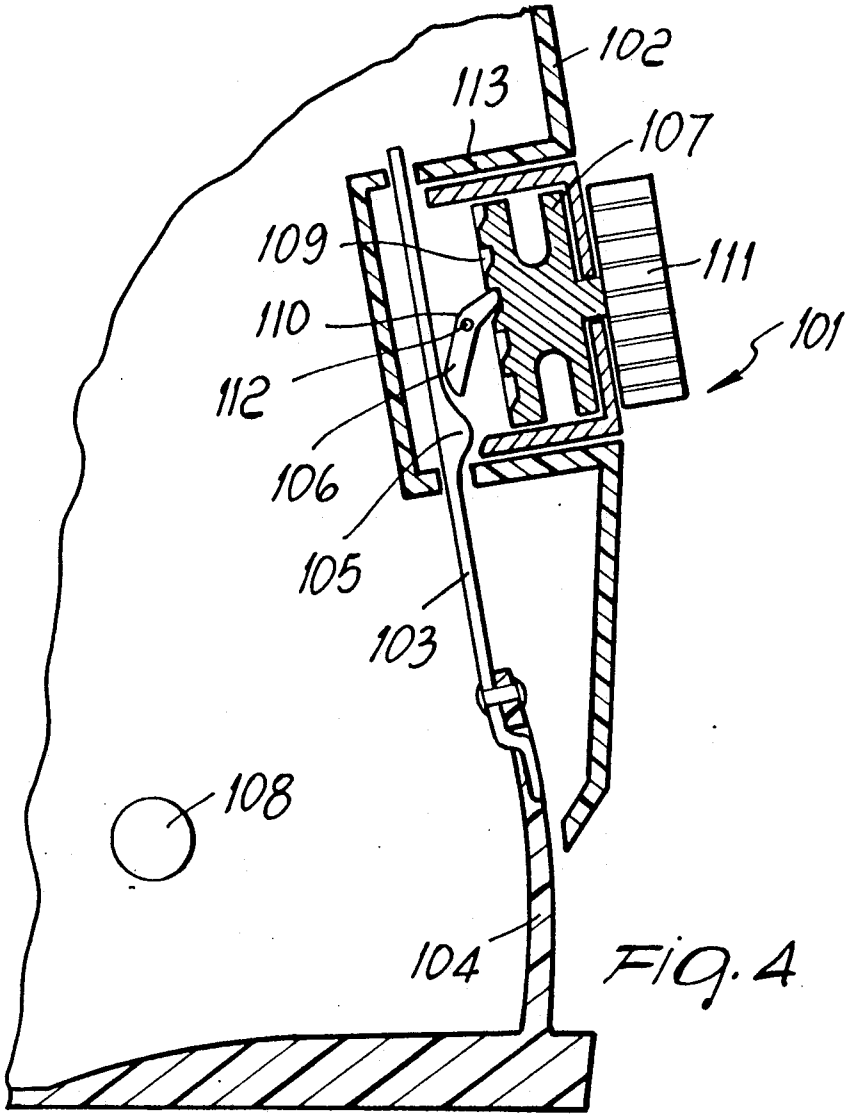
FIG. 4 is a partial sectioned side view of a ski boot, having a device according to a second aspect of the invention, and showing the rear quarter closed.

In fact, during this step the rearward motion of the rear quarter imparts a relative motion to the tab 11 with respect to the winding assembly 9, deactivating said removable locking means. One particular deactivation of the removable locking means of the winding assembly 9 when the tab 11 moves relatively thereto may be effected in a manner as shown in FIGS. 4 and 5 and described hereinafter.

This entails the automatic release of the foot inside the boot as soon as the skier rotates the rear quarter beyond a preset angle without requiring any further operation by the skier such as, for example, operating the knob 10.

Advantageously, the cable which can be recovered in said spool may be coaxially provided with a spring which is compressed during the foot securing step; this allows, upon the deactivation of the removable locking means of said spool, a rapid unwinding of the cable wound on the spool by virtue of the compression of said spring.

It has thus been observed that the invention has achieved the intended aim and objects, a device having been provided which allows to automatically release the foot securing device when the quarters are opened without acting directly on the knob of the winding assembly.

Accidental releases are thus avoided, since no direct contact is provided between the flap or the shell and the tab so as to cause immediate release due to a decrease in pressure at the means for the removable locking of the rotation of said cable in its unwinding direction.

Said device can furthermore be used in rear-entry ski boots which have a padding overlapping the flap which protrudes rearward from the shell at the heel region.

The device finally also combines simplicity in its opening operations, which is particularly appreciated in injury conditions, with the possibility to intervene on a single element to release the foot from the boot.

The invention is naturally susceptible to numerous other modifications and variations, all of which are within the scope of the same inventive concept.

FIGS. 4 and 5 show a ski boot 101 having a securing device according to a further aspect of the invention.

The ski boot 101 is composed of a shell 104 and at least a rear quarter 102 pivoted to the shell at pivot 108.

FIG. 4 shows the rear quarter closed and FIG. 5 shows the rear quarter in a partially open position.

The rear quarter 102 has a winding device 111 comprising a pulley 107 adapted to wind a cable (not shown).

Pulley 107 has ratchet means comprising saw teeth 109 engaging a toggle defined on the pulley flange or pawl 106 pivoted at pivot 110 and biased by a spring 112 in a locking position (shown at FIG. 4) in which the toggle 106 prevents the rotation of pulley 107.

According to the invention an elastic bar or tab 103 is connected to the shell 104, at its lower end, and has an upper portion inserted in the winding device housing 113 in sliding engagement.

The bar 103 has an inclined portion 105 adapted to interact with toggle 106 when the rear quarter 102 is opened.

Namely, when the rear quarter 102 is opened, i.e. rotated clockwise with reference to the drawings, the winding device housing 113 is displaced to the right and downwardly relatively to the bar 103.

Bar 103 is thus slightly bent and slides upwardly, relatively to housing 113, such that the inclined portion 105 acts on toggle 106 which rotates about pivot 110 disengaging the pulley 109.

When the quarter 102 is closed again, the elastic bar 103 returns to its straight position, shown in FIG. 4, and spring 112 again biases toggle 106 to lock the pulley 107.

The materials and the dimensions constituting the individual components of the device may also be the most pertinent according to the specific requirements.

We claim:

1. In a ski boot comprising a shell and at least one quarter being pivoted to said shell and having an open position and a closed position, a foot securing device with aromatic release, comprising a winding device associated with said quarter, a foot securing means arranged inside said boot, and a cable means being operatively connected with said foot securing means and with said winding device, said winding device having a pulley means adapted to wind said cable means to thereby adjust a degree of securement of said foot securing means, said winding device comprising means for releasably locking a rotation of said pulley means in a direction of unwinding of said cable means, said foot securing device further comprising a tab means having a first end connected to a fixed portion of said boot and a second end movably associated with said winding device such that said second end moves relatively to said winding device when said quarter is pivotally moved between said open position and said closed position, said second end of said tab means engaging with said means for releasably locking a rotation of said pulley means of said winding device when said quarter is pivotally moved from said closed position to said open position to thereby release said means for locking to allow said pulley means to rotate in said direction of unwinding of said cable means.

2. Device according to claim 1, wherein said quarter is a rear quarter and wherein said tab means are positioned in said boot in an interspace defined between an inner lateral surface of said rear quarter and an outer lateral surface of a flap which protrudes from said shell at a heal region of said boot, said fixed portion of said boot being constituted by a bridge element which connects said shell and said flap, said first end of said tab means interacting with a coupling element connected to said bridge element.

3. Device according to claim 2, wherein said coupling element is a clip coupling element connected to a transverse lug which protrudes from said bridge.

4. Device according to claim 1, wherein said quarter is a rear quarter and wherein said first end of said tab means is connected to a heel region of said shell.

5. In combination, a ski boot and a foot securing device with automatic release, said ski boot comprising a shell and at least one quarter pivoted to said shell, said quarter having an open position and a closed position, said foot securing device comprising a winding device associated with said quarter, a foot securing means arranged inside said boot, and a cable means being operatively connected between said foot securing means and said winding device, said winding device having a pulley means adapted to wind said cable means to thereby adjust a degree of securement of said foot securing means, said winding device comprising means for releasably locking a rotation of said pulley means in a direction of unwinding of said cable means, said means for releasably locking said pulley means comprising ratchet element means, said foot securing device further comprising a tab means having a first end connected to a fixed portion of said boot and a second end movably associated with said winding device such that said second end moves relatively to said winding device when said quarter is pivotally moved between said open position and said closed position, said second end of said tab means being provided with interacting portion means, said interacting portion means of said second end of said tab means engaging with said ratchet element means of said means for releasably locking a rotation of said pulley means of said winding device when said quarter is pivotally moved from said closed position to said open position to thereby release said means for locking to allow said pulley means to rotate in said direction of unwinding of said cable means.

6. A foot securing device with automatic release, particularly for rear-entry ski boots, said ski boot comprising a shell and a rear quarter pivoted to said shell, said rear quarter having an open position and a closed position, said foot securing device comprising a winding device associated with said rear quarter, a foot securing means arranged inside said boot, and a cable means being operatively connected with said foot securing means and with said winding device, said winding device having a pulley means adapted to wind said cable means to thereby adjust a degree of securement of said foot securing means, said winding device comprising means for releasably locking a rotation of said pulley means in a direction of unwinding of said cable means, said means for releasably locking said pulley means comprising ratchet element means including a pawl means interacting with a toothed flange means, said foot securing device further comprising a tab means having a first end connected to a fixed portion of said boot and a second end movably associated with said winding device such that said second end moves relatively to said winding device when said quarter is pivotally moved between said open position and said closed position, said second end of said tab means being provided with interacting portion means, said interacting portion means of said second end of said tab means engaging with said pawl means of said means for releasably locking a rotation of said pulley means of said winding device when said quarter is pivotally moved form said closed position to said open position to thereby release said means for locking to allow said pulley means to rotate in said direction of unwinding of said cable means.

7. Device according to claim 6, wherein said toothed flange means comprise saw teeth defined on a flange of said pulley means and wherein said pawl means comprise a spring loaded toggle element biased in a locking position of engagement with said saw teeth, said second end of said tab means being inserted in sliding engagement in a housing of said winding device, said interacting portion means being constituted by an inclined portion defined on said second end and being adapted to engage said toggle element to thereby disengage said toggle element from said locking position.

* * * * *